US008398031B2

(12) United States Patent
Gawelczyk et al.

(10) Patent No.: US 8,398,031 B2
(45) Date of Patent: Mar. 19, 2013

(54) RAIL SYSTEM, PARTICULARLY FOR AN ELECTRIC PALLET TRACK

(75) Inventors: Klaus Gawelczyk, Stuttgart (DE); Martin Waeder, Weil im Schoenbuch (DE); Michael Hoehne, Holzgerlingen (DE)

(73) Assignee: Eisenmann AG (DE)

( * ) Notice: Subject to any disclaimer, the term of this patent is extended or adjusted under 35 U.S.C. 154(b) by 0 days.

(21) Appl. No.: 13/104,352

(22) Filed: May 10, 2011

(65) Prior Publication Data

US 2011/0290145 A1 Dec. 1, 2011

(30) Foreign Application Priority Data

May 26, 2010 (DE) ..... 10 2010 021 594

(51) Int. Cl.
*E01B 7/00* (2006.01)

(52) U.S. Cl. ..... 246/415 R; 104/102; 104/130.01; 104/307

(58) Field of Classification Search ..... 246/415 R, 246/419, 430, 257, 262; 104/96, 99, 102, 104/130.01, 130.06
See application file for complete search history.

(56) References Cited

U.S. PATENT DOCUMENTS

| | | | | |
|---|---|---|---|---|
| 2,138,962 | A * | 12/1938 | Forker, Jr. | 104/102 |
| 2,996,017 | A * | 8/1961 | Gorjanc et al. | 104/102 |
| 3,356,039 | A * | 12/1967 | Fonden et al. | 104/130.01 |
| 3,356,040 | A * | 12/1967 | Fonden | 104/130.01 |
| 4,109,584 | A * | 8/1978 | Mihirogi | 104/130.06 |
| 4,920,891 | A * | 5/1990 | Loomer | 104/102 |
| 5,154,123 | A * | 10/1992 | Loomer | 104/102 |
| 5,193,767 | A * | 3/1993 | Mihirogi | 246/418 |
| 5,247,890 | A * | 9/1993 | Mihirogi | 104/130.11 |
| 5,857,413 | A * | 1/1999 | Ward | 104/48 |
| 6,389,981 | B1 * | 5/2002 | Strothmann et al. | 104/48 |
| 2010/0000440 | A1 * | 1/2010 | Meinzinger | 104/102 |
| 2010/0050899 | A1 * | 3/2010 | Tabler | 104/96 |
| 2010/0147183 | A1 * | 6/2010 | Weissbrodt | 104/307 |
| 2011/0290145 | A1 * | 12/2011 | Gawelczyk et al. | 104/130.01 |

FOREIGN PATENT DOCUMENTS

DE 20 2008 016 678 U1 4/2009

* cited by examiner

*Primary Examiner* — S. Joseph Morano
*Assistant Examiner* — Jason Smith
(74) *Attorney, Agent, or Firm* — Factor Intellectual Property Law Group, Ltd.

(57) ABSTRACT

A rail system for an electric pallet track has, in known manner, a main line which can be optionally connected to at least two branch lines by way of points. The points have as many movable rail portions for each rail of the main line as there are branch lines. These movable rail portions can each be pivoted about a stationary pivot axis which is located outside the longitudinal extent of the corresponding movable rail portion.

6 Claims, 5 Drawing Sheets

RAIL SYSTEM, PARTICULARLY FOR AN ELECTRIC PALLET TRACK

CROSS-REFERENCE TO RELATED APPLICATIONS

This application claims the filing benefit of German Patent Application No. 10 2010 021 594.5 filed May 26, 2010 the contents of which are incorporated herein by reference.

FIELD OF THE INVENTION

The invention relates to a rail system, particularly for an electric pallet track, having a) a main line which comprises at least two stationary parallel rails;

b) at least two branch lines which form an angle and each have as many stationary parallel rails as the main line;

c) points arranged between the main line and the branch line, which comprise:

ca) as many movable rail portions for each rail of the main line as there are branch lines, which are optionally capable of connecting the rails of the different branch lines to the rails of the main line depending on their position;

cb) at least one drive for moving the movable rail portions.

BACKGROUND OF THE INVENTION

Whilst, in the prior art, points were frequently used which required the vehicle crossing the points to be stopped during their adjustment, in more recent times there has been an increase in the use of continuously operating points, where the vehicle can cross the points without stopping. The advantages of continuously operating points of this type are obvious: the throughput of vehicles through the rail system is greater since time is not required for braking, stopping and reaccelerating the vehicle in the region of the points.

Continuously operating points of the type mentioned at the outset are described in DE 20 2008 010 439 U1. Here, the movable rail portions of the points are displaced linearly. However, this is associated with a relatively large spatial requirement. Owing to the inertia of the system, only relatively long switching times of the points are possible. This reduces the throughput of the rail system.

Further continuously operating points are disclosed in DE 20 2008 016 78 U1. Here, the movable rail portions are arranged on a turntable and are all rotated together about a centre of rotation which corresponds to the centre of rotation of the turntable. However, the overall height of a construction of this type is substantial and in many cases requires an inherently undesirable pit.

The present invention is directed to resolving these and other matters.

SUMMARY OF THE INVENTION

An object of the present invention is to provide a rail system of the type mentioned at the outset, in which the points are also suitable for narrow space ratios.

This object may be achieved according to the invention in that d) the movable rail portions can each be pivoted about a stationary pivot axis;

e) the pivot axes are arranged outside the longitudinal extent of the associated movable rail portions at a spacing from their ends.

With the inventive type of movement of the movable rail portions, namely a pivotal movement about a pivot axis which is at a relatively large spacing from the rail portion, it is possible to manage with relatively little space. Moreover, there is no need for the ends of the movable rail portions and the stationary rails cooperating therewith to be notably rounded. This means that the track rollers and lateral guidance rollers of the vehicles travelling over the rails are constantly supported. Only very narrow gaps occur in the region of the rail joints on the side faces of the rails. This is of particular significance where the side faces are used to mount power rails or similar contact devices, as is the case in electric pallet tracks.

At least one geometrical pivot axis advantageously passes through that stationary rail or that stationary rail portion which may be connected to the movable rail portion associated with the pivot axis. This is also conducive to enabling the end faces of the stationary rails and the movable rail portions to be kept as level as possible in the joint regions.

The geometrical pivot axis expediently passes through the stationary rail or the stationary rail portion at a spacing from its end. This enables the radius at which the end of the movable rail portion moves during the pivotal movement to be increased, which again improves the possibility of keeping the end faces of the rails and rail portions level in the region of rail joints and minimising the occurrence of gaps.

The substantial freedom from gaps is, as already indicated above, particularly important where at least one stationary rail of each line and the movable rail portions which may be brought into contact with this stationary rail support electric power rails and/or other electric lines on a side face. Since, as explained several times, gaps in the region of rail joints are very small in the present invention, the spacings between the electric power rails or other electric lines of the stationary rails and those of the associated movable rail portions in the region of the joints can also be kept small.

It is to be understood that the aspects and objects of the present invention described above may be combinable and that other advantages and aspects of the present invention will become apparent upon reading the following description of the drawings and detailed description of the invention.

DETAILED DESCRIPTION OF THE DRAWINGS

Figure 1:
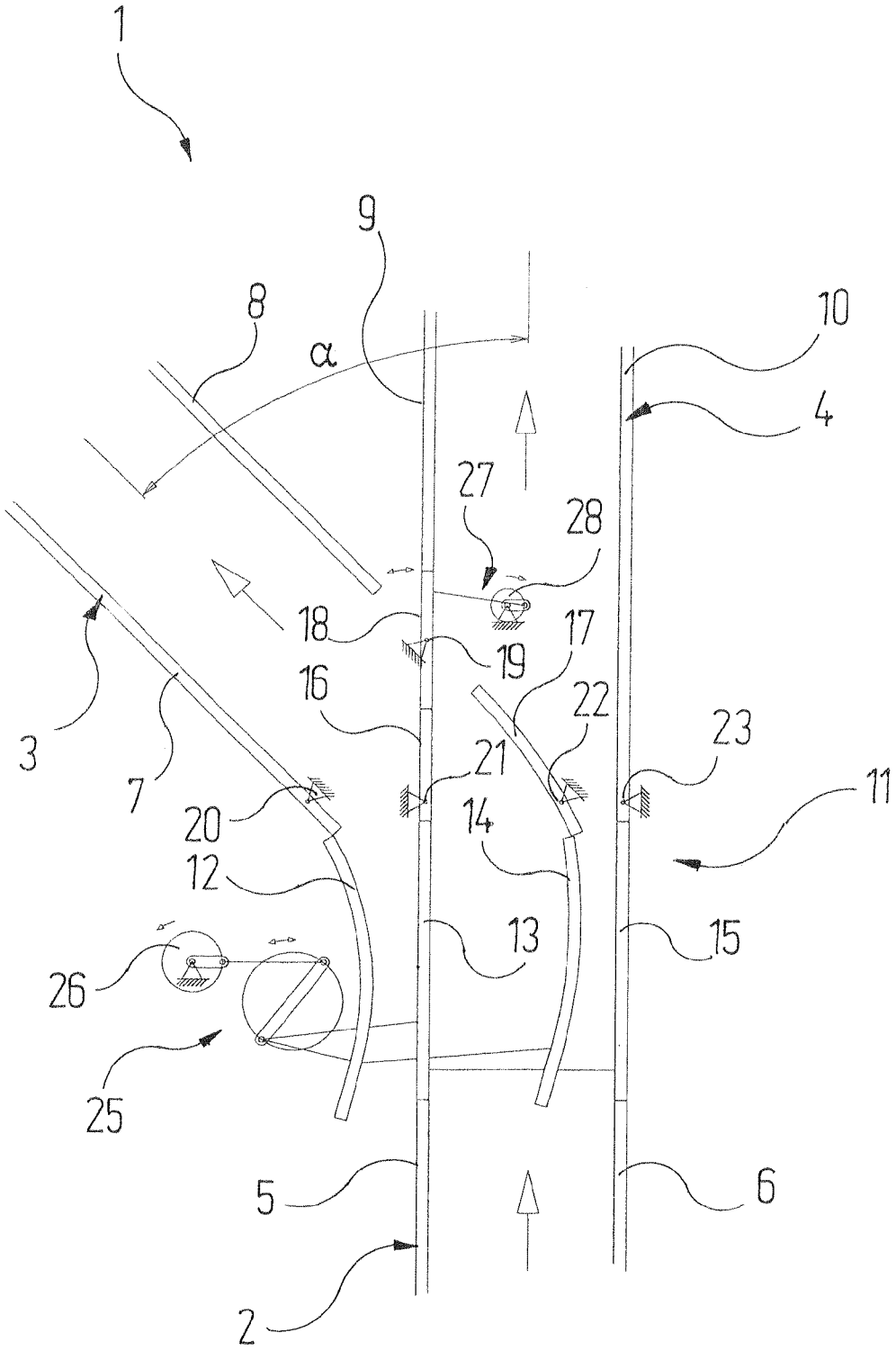
FIG. 1 the plan view of a rail system with a first exemplary embodiment of points in one points position.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
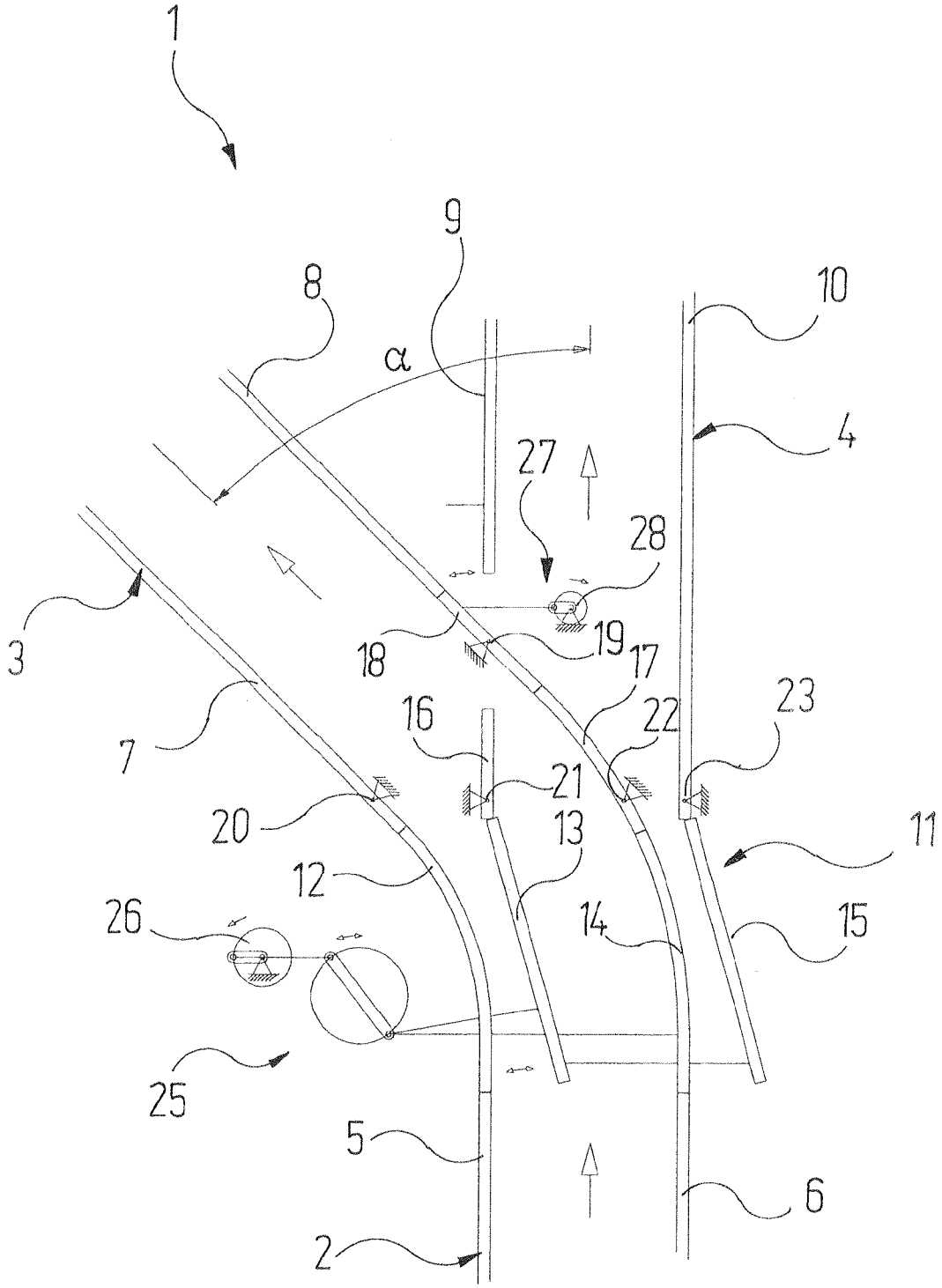
FIG. 2 the plan view of the rail system of FIG. 1 in the other points position.

Reference is firstly made to FIGS. 1 and 2, which show a rail system which is denoted as a whole by the reference numeral 1 and which comprises a main line 2 and two branch lines 3, 4 in the detail shown. Each line 2, 3, 4 comprises two parallel rails 5, 6 and 7, 8 and 9, 10 respectively. The lines 2, 3 and 4 and therefore also the rails 5, 6, 7, 8, 9, 10 are stationary. Whilst the branch line 4 is located in the linear continuation of the main line 2, the branch line 3 branches off from the other branch line 4 at a particular angle α, which is approximately 45° in the exemplary embodiment shown.

The main line 2 can be connected optionally to the branch line 3 or the branch line 4 with the aid of points denoted as a whole by the reference numeral 11. The points 11 comprise two pivotable rail portions 12, 13 which are associated with the rail 5, and two pivotable rail portions 14, 15 which are associated with the rail 6. The rail portion 12 here is curved such that, in one of its pivotal positions (illustrated in FIG. 2), it can connect the end of the stationary rail 5 of the main line 2 to the end of the stationary rail 7 of the branch line 3. The rail portion 13 of the points 11 is linear and is of such a length that, in one points position—namely that shown in FIG. 1—it connects the end of the stationary rail 5 of the main line 2 to a stationary intermediate rail portion 16 which is linear and is aligned with the rail 5 of the main line 2 and the rail 9 of the branch line 4.

The movable rail portion 14 has such a curvature and such a length that it can connect the end of the rail 6 of the main line 2 to the end of a curved stationary intermediate rail portion 17 in one points position, as shown in FIG. 2.

The linear pivotable rail portion 15 of the points 11 finally has such a length that it can connect the end of the rail 6 of the main line 2 to the end of the rail 10 of the branch line 4. The corresponding position is shown in FIG. 1.

The points 11 finally comprise a further rotatable rail portion 18 which is linear and can optionally connect that end of the stationary intermediate rail portion 16 which faces the branch line 4 to the rail 9 of the branch line 4, as shown in FIG. 1, or that end of the stationary curved intermediate rail portion 17 which faces in the direction of the branch line 3 to the end of the rail 8 of the branch line 3, as shown in FIG. 2.

Whilst the centre of rotation 19 of the rotatable rail portion 18 is simply located in known manner in the centre of the rotatable rail portion 18, the pivot axes 20, 21, 22, 23 of the pivotable rail portions 12, 13, 14, 15 of the points 11 have a specific feature: all of these pivot axes 20, 21, 22, 23 are located outside the longitudinal extent of the associated pivotable rail portion 12, 13, 14, 15, in particular not at the end of the respective pivotable rail portion 12, 13, 14, 15.

In the rail system 1 illustrated in FIGS. 1 and 2, the pivot axis 20 about which the rail portion 12 can be pivoted is located in the region of the rail 7 of the branch line 3, and more precisely at a particular spacing from its end. When, in the present connection, the term "in the region of" is used, this means that the geometrical pivot axis 20 of the movable rail portion 12 passes through the stationary rail 7 or, in any case, is located very near to this. The pivot axis 21, which is associated with the linear pivotable rail portion 13, is located in the region of the stationary intermediate rail portion 16, again at a particular spacing from its end. In corresponding manner, the pivot axis 22, which is associated with the pivotable curved rail portion 14, is located in the region of the curved stationary intermediate rail portion 17, somewhat remote from its end. Finally, the pivot axis 23, which belongs to the linear pivotable rail portion 15, is located in the region of the rail 10 of the branch line 4, again at a spacing from its end.

The point of the described positioning of the different pivot axes 20, 21, 22, 23 is that, as far as possible, the rail portions 12, 13, 14, 15 can be pivoted free of play into their respective positions, without the ends of the pivotable rail portions 12, 13, 14, 15 or the adjacent stationary rails 5, 6, 7, 8, 9, 10 or the stationary intermediate rail portions 16, 17 having to be notably rounded. Such rounding would be necessary, for example, if the pivot axis were provided directly at the end of the respective rail portion 12, 13, 14, 15. Since, as mentioned, it is possible with the inventive positioning of the pivot axes 20, 21, 22, 23 to avoid rounded portions of this type, at the most very narrow gaps form at the joints of the pivotable rail portions 12, 13, 14, 15 with the respective rails 7, 8, 9, 10 or the stationary intermediate rail portions 16, 17.

The mechanism by which the pivotable rail portions 12, 13, 14, 15 can be pivoted about the pivot points 20, 21, 22, 23 between the two points positions illustrated in FIGS. 1 and 2 is denoted as a whole by the reference numeral 25 in the drawing and is only shown very schematically. As an example of a drive, it comprises an electric motor 26 which then drives further transmission elements which generate the reciprocating movement required to pivot the rail portions 12, 13, 14, 15 in a manner known per se from the rotational movement of the electric motor 26. One option for this is indicated schematically in the drawing and does not require further explanation here.

In similar manner, a rotary mechanism 27, which likewise has an electric motor 28, provides for the rotation of the rotatable rail portion 18 about the axis of rotation 19.

It goes without saying that the rail portions 12, 13, 14, 15 are suitably controlled so that they can be moved back and forth precisely between the two points positions illustrated in FIGS. 1 and 2.

Figure 3:
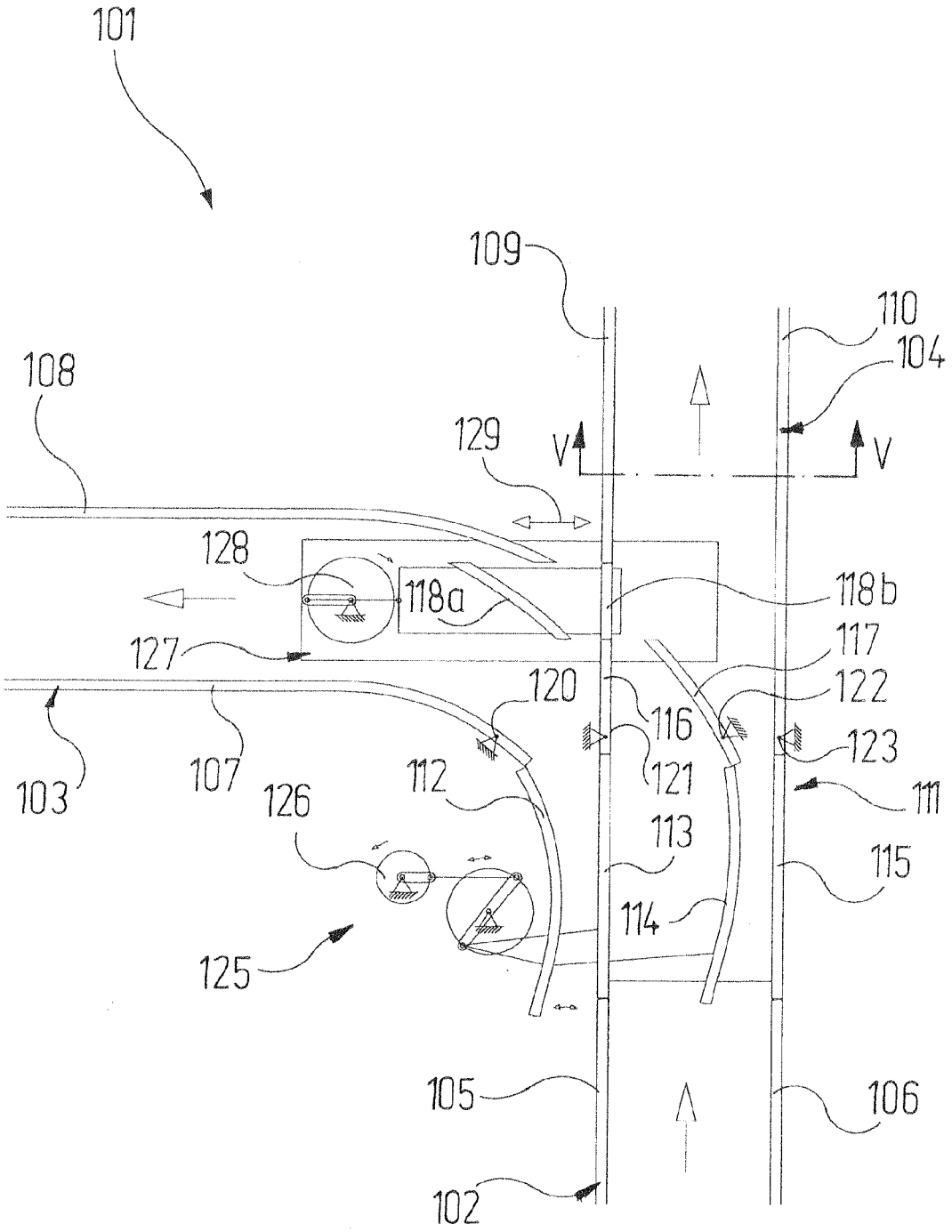
FIG. 3 the plan view of a rail system with a second exemplary embodiment of points in a first points position.
Figure 4:
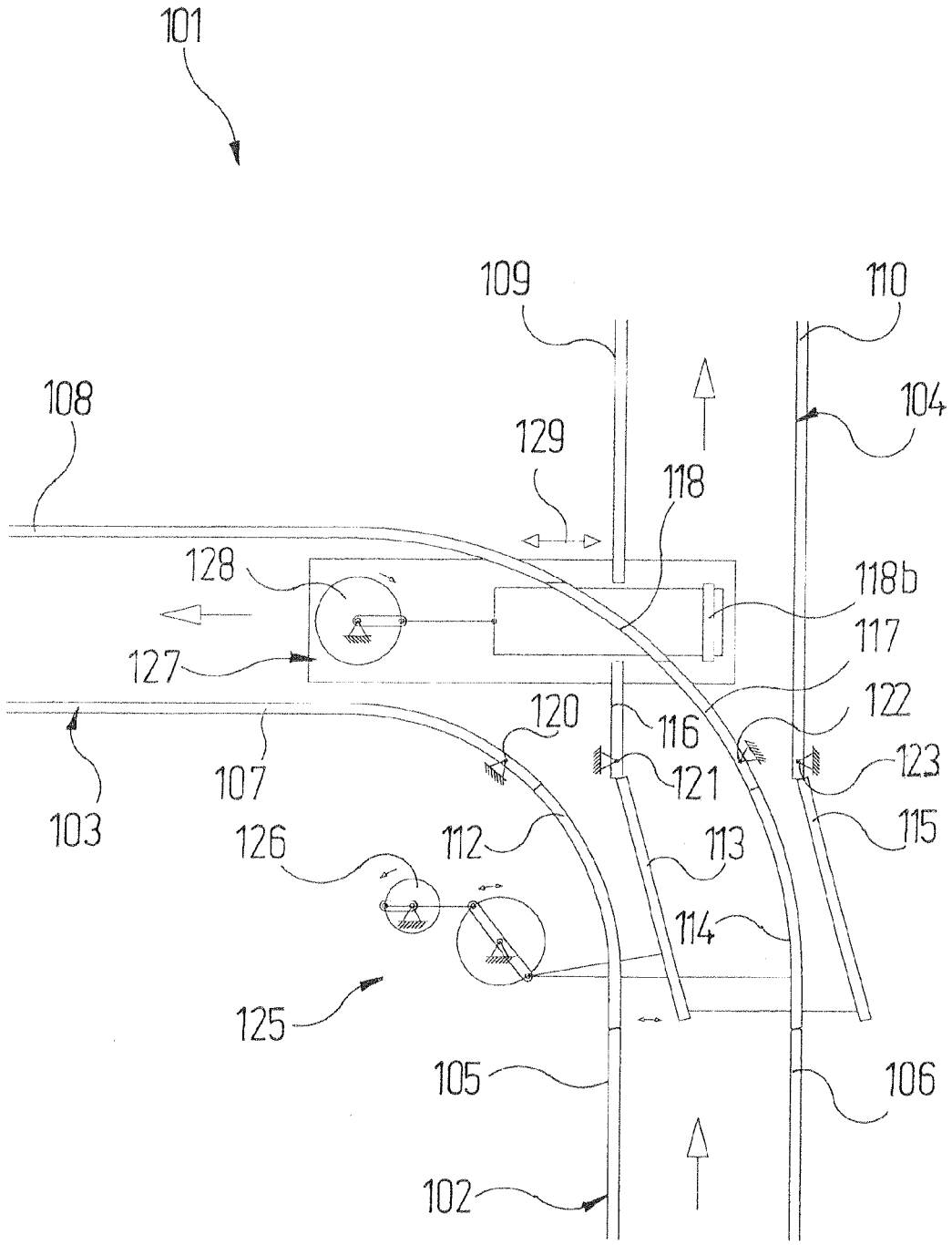
FIG. 4 the plan view of the rail system of FIG. 3 in the other points position.

The exemplary embodiment of a rail system 101, illustrated in FIGS. 3 and 4, is very similar to that described above with reference to FIGS. 1 and 2. Corresponding components are therefore denoted by the same reference numerals plus 100.

The rail system 101 of FIGS. 3 and 4 also comprises a main line 102 and two branch lines 103 and 104. The two branch lines 103 and 104 in this case form an angle of approximately 90°. The points 111 which connect the main line 102 to the two branch lines 103 and 104 correspond to the points 11 of the first exemplary embodiment, with just one exception.

Instead of the rotatable rail portion 18 in the "frog", the points 111 comprise two movable rail portions 118*a*, 118*b*. The two rail portions 118*a*, 118*b* can be moved linearly back and forth in the direction of the double-headed arrow 129 by a slide mechanism 127. This enables the linear movable rail portion 118*b*, as shown in FIG. 3, to be inserted between the end of the stationary intermediate rail portion 116 and the end of the rail 109 of the branch line 104 or the curved rail portion 118*a* can be fitted into place between the end of the curved stationary intermediate rail portion 117 and the in this case curved end region of the rail 108 of the branch line 103. This latter position is shown in FIG. 4.

Figure 5:
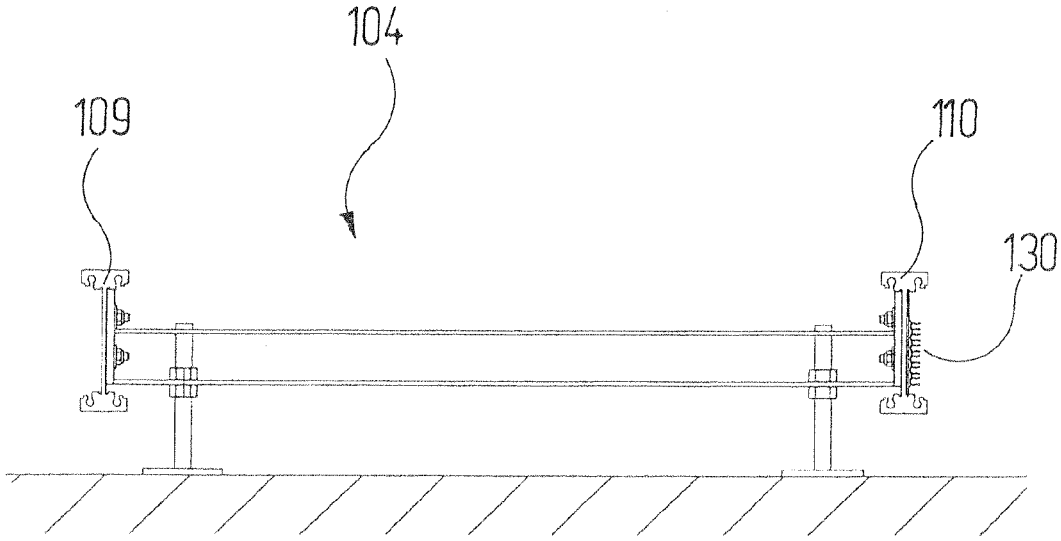
FIG. 5 a section according to line V-V of FIG. 3.

Both rail system 1 and 101 described above with reference to FIGS. 1 to 4 are intended for an electric pallet track in which pallet-carrying vehicles, each provided with a separate electric drive motor, are moved along the rail system 1, 101. To this end, the different vehicles have to be supplied both with an electrical voltage to power the drive motor and also optionally with control signals. To this end, as shown in the section of FIG. 5, sliding contacts 130, which cooperate with corresponding consumers of the individual vehicles, are provided on the side face of at least one rail of each line 2, 3, 4 or 102, 103, 104.

Owing to the above-described construction of the points and the associated small gaps at the joints of the different rail portions, the breaks between the sliding contacts on the different rail portions also remain small, which means that there are no problems as the corresponding breaks are crossed.

It goes without saying that the rail systems 1, 101 described can be implemented in both directions and not only in the direction characterised by arrows in the drawing.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A rail system, particularly for an electric pallet track, comprising:

a main line which comprises at least two stationary parallel rails;

at least two branch lines which form an angle with each other and each of which includes as many stationary parallel rails as the main line; and, points arranged between the main line and the branch line, which comprise as many movable rail portions for each rail of the main line as there are branch lines and which are capable of selectively connecting the rails of the different branch lines to the rails of the mail line depending on the position of the movable rail portions; and, at least one drive for moving the movable rail portions, and, at least one additional rail portion in a frog of the points which is rotatably or linearly movable; and, wherein, the movable rail portions can each be pivoted about a stationary pivot axis, and further wherein the pivot axes are arranged outside a longitudinal extent of the associated movable rail portion at a spacing from its end.

2. The rail system of claim 1, wherein at least one pivot axis passes through that stationary rail or that stationary rail portion which may be connected to the movable rail portion associated with the pivot axis.

3. The rail system of claim 2, wherein the pivot axis passes through the stationary rail or the stationary rail portion at a spacing from its end.

4. The rail system of claim 3, wherein at least one stationary rail of each line and the movable rail portions which may be brought into contact with a stationary rail support electrical sliding contacts on a side face.

5. The rail system of claim 2, wherein at least one stationary rail of each line and the movable rail portions which may be brought into contact with a stationary rail support electrical sliding contacts on a side face.

6. The rail system of claim 1, wherein at least one stationary rail of each line and the movable rail portions which may be brought into contact with a stationary rail support electrical sliding contacts on a side face.

* * * * *